US008370972B2

(12) United States Patent
Shriver

(10) Patent No.: US 8,370,972 B2
(45) Date of Patent: Feb. 12, 2013

(54) SUPINE LIFT AND STRETCHER

(76) Inventor: Fredrick C Shriver, Vista, CA (US)

( * ) Notice: Subject to any disclaimer, the term of this patent is extended or adjusted under 35 U.S.C. 154(b) by 176 days.

(21) Appl. No.: 12/828,688

(22) Filed: Jul. 1, 2010

(65) Prior Publication Data

US 2011/0000016 A1 Jan. 6, 2011

Related U.S. Application Data

(60) Provisional application No. 61/222,466, filed on Jul. 1, 2009.

(51) Int. Cl.
*A61G 7/10* (2006.01)

(52) U.S. Cl. ..... 5/86.1; 5/81.1 R; 5/83.1; 5/85.1; 5/87.1

(58) Field of Classification Search ..... 5/86.1, 5/81.1 R, 81.1 HS, 89.1, 83.1, 85.1, 87.1
See application file for complete search history.

(56) References Cited

U.S. PATENT DOCUMENTS

| | | | | |
|---|---|---|---|---|
| 5,379,468 | A * | 1/1995 | Cassidy et al. | 5/86.1 |
| 5,810,104 | A * | 9/1998 | Campbell | 180/19.3 |
| 2005/0193488 | A1 * | 9/2005 | Blevins | 5/86.1 |
| 2007/0251004 | A1 * | 11/2007 | Wang | 5/81.1 R |
| 2010/0138997 | A1 * | 6/2010 | Hoppner et al. | 5/601 |
| 2010/0293713 | A1 * | 11/2010 | Sharps et al. | 5/86.1 |

* cited by examiner

*Primary Examiner* — Robert G Santos
*Assistant Examiner* — Brittany Wilson
(74) *Attorney, Agent, or Firm* — Michael Ries

(57) ABSTRACT

A lift and stretcher apparatus for a patient includes a base portion at least partially defined by an elongated portion extending generally in a first orthogonal direction and having a first end, a second end, and a central portion interposed there between; a frame having a first lateral portion extending in the first orthogonal direction and defining a first lateral portion distal end and a first lateral portion proximal end, a second lateral portion defining a second lateral portion distal end and a second lateral portion proximal end, a proximal portion, and a distal portion extending generally in a second orthogonal direction; a lifting portion interconnecting the base with the frame for moving the frame relative to the base generally in a third orthogonal direction; a first axle portion having; and a second axle portion.

11 Claims, 6 Drawing Sheets

SUPINE LIFT AND STRETCHER

CROSS-REFERENCE TO RELATED APPLICATIONS

This application claims priority to U.S. Provisional Application 61/222,466, filed on Jul. 1, 2009; the disclosure of which is incorporated by reference in its entirety.

TECHNICAL FIELD

The disclosure relates generally to stretchers and lifts for moving and transporting patients.

BACKGROUND

Many times in a hospital or other care giving facility, a person is transferred from one bed or stretcher to another. Generally, the person is in a supine position. This maneuver may increase the risk that a person is undesirably handled in a manner that may cause injury. Further, more than one person may be required to transfer a person one bed or stretcher to another, thus requiring additional personnel or requiring an undesirable wait until additional personnel are available.

What is needed is a device or apparatus for moving a person in a supine position. A desirable device would permit a minimum number of people for the transfer and reduce the occurrences of inadvertent injury. The device needs to have features that allow it to be easily maneuvered in its role as a transporter yet be capable of fitting around the varied patient surfaces it will encounter as a supine lift.

SUMMARY

In an embodiment, a stretcher is provided to move a patient. The stretcher is moveable on wheels and provides a mechanism to connect to a sling portion that the patient is positioned on and then lift the patient generally vertically to clear a hospital bed. The device has features that allow it to be easily maneuvered in its role as a transporter yet be capable of fitting around the varied patient surfaces it will encounter as a supine lift.

BRIEF DESCRIPTION OF THE DRAWINGS

The drawings are illustrative embodiments. The drawings are not necessarily to scale and certain features may be removed, exaggerated, moved, or partially sectioned for clearer illustration. The embodiments illustrated herein are not intended to limit or restrict the claims.

DETAILED DESCRIPTION

Figure 1:
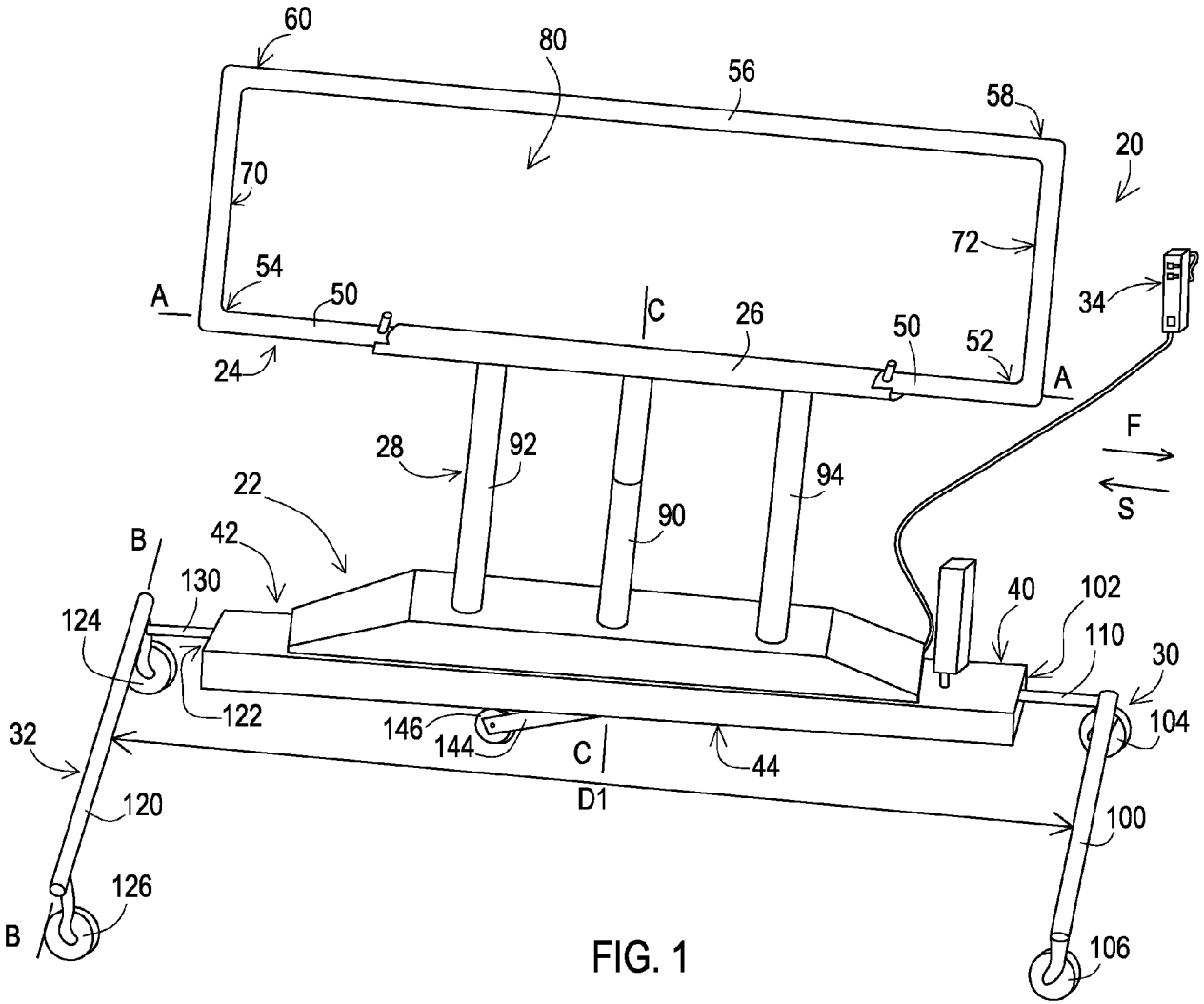
FIG. 1 is perspective view of an apparatus according to an embodiment.

FIG. 1 illustrates an embodiment of an apparatus 20. The apparatus 20 includes a base 22, a frame 24, an upper member 26, a lifting portion 28, a first axle portion 30, a second axle portion 32, and a control 34.

In the embodiment illustrated, the base portion 22 is at least partially defined by an elongated portion extending generally parallel to a first orthogonal axis A-A and having a distal end 40, a proximal end 42, and a central portion 44 interposed therebetween.

The frame 24 includes a first lateral portion 50 extending along the first orthogonal axis A-A and defining a first lateral portion distal end 52, and a first lateral portion proximal end 54, a second lateral portion 56 defining a second lateral portion distal end 58 and a second lateral portion proximal end 60, a proximal portion 70 selectively extending generally parallel to a second orthogonal axis B-B and interconnecting the first lateral portion proximal end 54 and the second lateral portion proximal end 60, and a distal portion 72 extending generally in a second orthogonal direction extending generally parallel to the second orthogonal axis B-B and interconnecting the first lateral portion distal end 52 and the second lateral portion distal end 58. As illustrated, at least two of the first lateral portion 50, the second lateral portion 52, the proximal portion 70, and the distal portion 72 define a frame opening 80. The frame 24 also includes a plurality of buckle portions 82 coupled thereon and spaced apart about the frame opening 80, as discussed in greater detail below.

Figure 3:
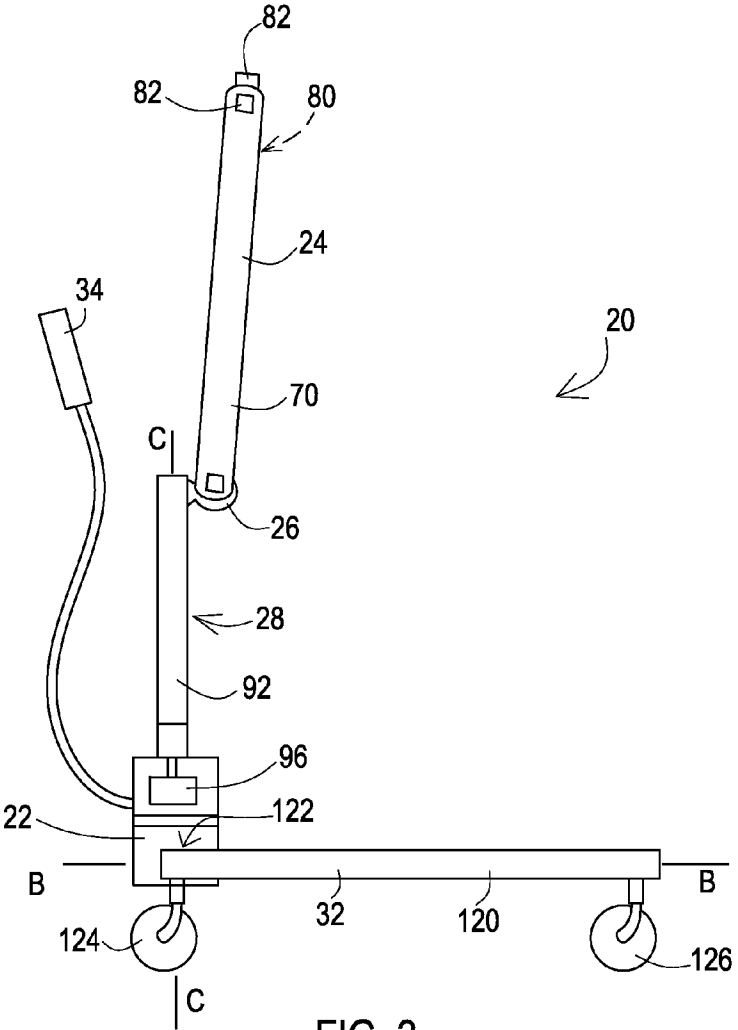
FIG. 3 is a side view of the apparatus of FIG. 1, in a first configuration.
Figure 4:
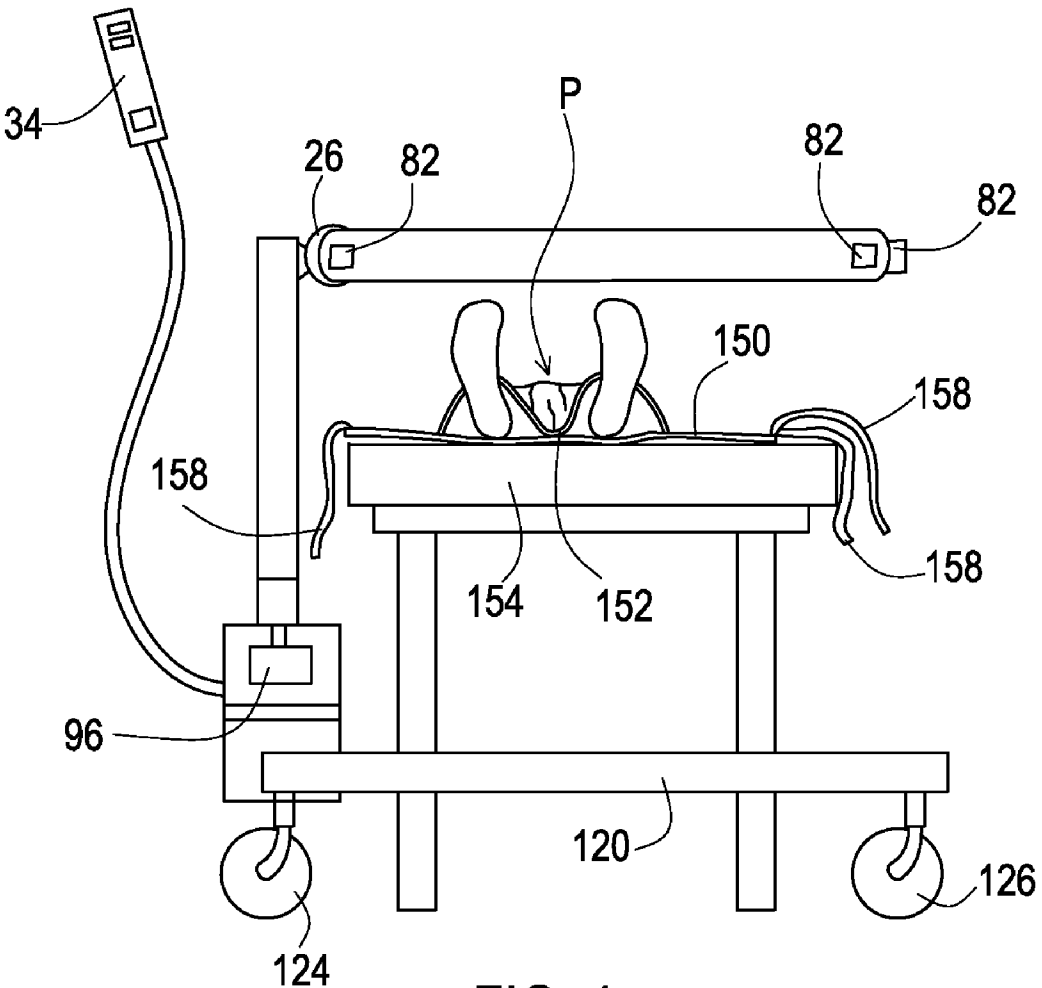
FIG. 4 is a side view of the apparatus of FIG. 1, in a second configuration.

The upper member 26 includes the first lateral portion 50 at least partially interposed therein and rotatable relative thereto, such that the proximal portion 70 and the distal portion 72 will each extend generally in the third orthogonal axis C-C (a first configuration of FIGS. 1 and 3) and then the frame 24 be allowed to rotate about the axis A-A until the proximal portion 70 and the distal portion 72 will each extend generally in the second orthogonal axis B-B (a second configuration of FIG. 4).

Figure 5:
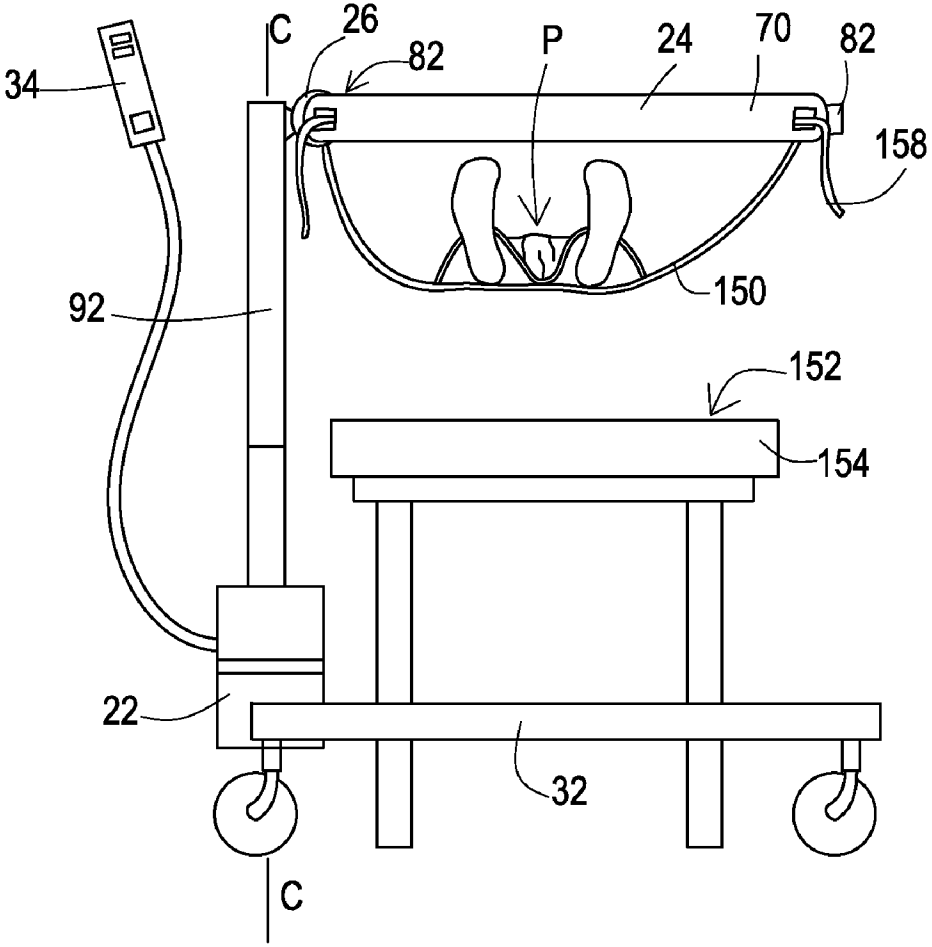
FIG. 5 is a side view of the apparatus of FIG. 1, illustrated in a third configuration.

The lifting portion 28 interconnects the base 22 with the frame 24 for moving the frame 24 relative to the base 22 generally parallel to the third orthogonal axis C-C between a lowered position (the second configuration of FIG. 4), and a raised position (a third configuration of FIG. 5). As best seen in FIG. 1, the lifting portion 28 includes a lifting arm 90, a first guide portion 92, and a second guide portion 94. The lifting arm 90 is operatively coupled to a lifting actuator 96 (FIG. 3) that may raise and lower the frame 24 in relation to the base 22. The first guide portion 92 and the second guide portion 94 reduce rotation of the frame 24 relative to the base 22 about the third orthogonal axis C-C.

The first axle portion 30 and the second axle portion 32 each include at least one wheel for transportation of the apparatus 20. Specifically, the first axle portion 30 includes an axle 100 extending generally parallel to the axis B-B, a first coupling mechanism 102, a wheel 104, and a wheel 106. The coupling mechanism 102 includes a first driver 108 and a first driven portion 110. The driven portion 110 interconnects the axle 100 with the driver 108 such that the axle 100 may be moved generally parallel to the axis A-A. The second axle portion 32 includes an axle 120 extending generally in the axis B-B, a second coupling mechanism 122, a wheel 124, a wheel 126 a second driver 128, and a second driven portion 130. The driven portion 130 interconnects the axle 120 with the driver 128 such that the axle 120 may be moved generally parallel to the axis A-A. This translation of the axles 100, 120 relative to the base 22 is best illustrated in a comparison between FIG. 1, where a distance between axles 100, 120 (wheelbase) is D1, and FIG. 6, where a distance between axles 100, 120 is D2. As illustrated, distance D2 is greater than distance D1. The capability to move each axle 100, 120 relative to the base 22 may assist in reducing the wheelbase for maneuvering the apparatus 20 through a corridor of a building, or may assist in altering the wheelbase for preventing contact between the first axle portion 30 and the second axle portion 32 and the lower portions of a hospital bed (legs, undercarriage, etc.), such as the exemplary bed 154.

Accordingly, the first axle portion 30 and the second axle portion 32 are coupled to the base 22 and may be moved relative to the base 22 generally parallel to the first orthogonal axis A-A. Importantly, the first axle portion 30 and the second axle portion 32 may be moved relative to the base 22 while a patient is being supported by the apparatus 20. Accordingly, the distance between the axle portions 30, 32 may be reduced to navigate the apparatus through doorways or other obstacles.

Figure 6:
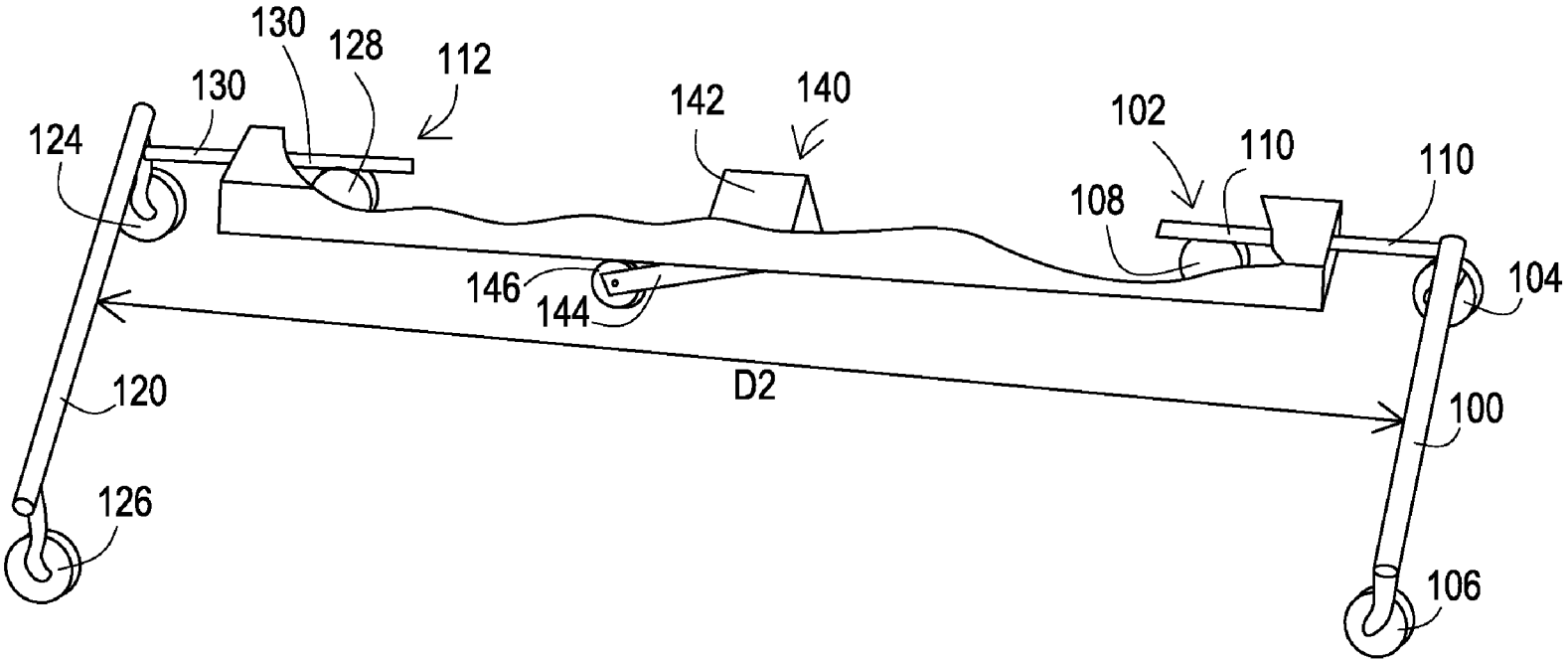
FIG. 6 is a partial cut-away view of a portion of the apparatus of FIG. 1, illustrated in a third configuration.

As best seen in FIG. 6, the base 22 also includes a covered or uncovered lower control portion 140 including a driver 142, a lower control arm 144 and a lower floor rolling contacting portion 146. In operation, the driver 142 may rotate the arm 144 such that the rolling portion 146 contacts the floor and then exerts a force on the floor. This creates a guide device while transporting.

The control 34 includes a plurality of control actuation portions that may control lifting and lowering the frame 24 generally parallel to the axis C-C and moving the first axle portion 30 and the second axle portion 32 generally parallel to the axis A-A. In an embodiment, the control 34 sends a signal to each of the lifting drier 96, the first driver 108, the second driver 128 and the driver 142 for controlling operation of the apparatus 20.

Figure 2:
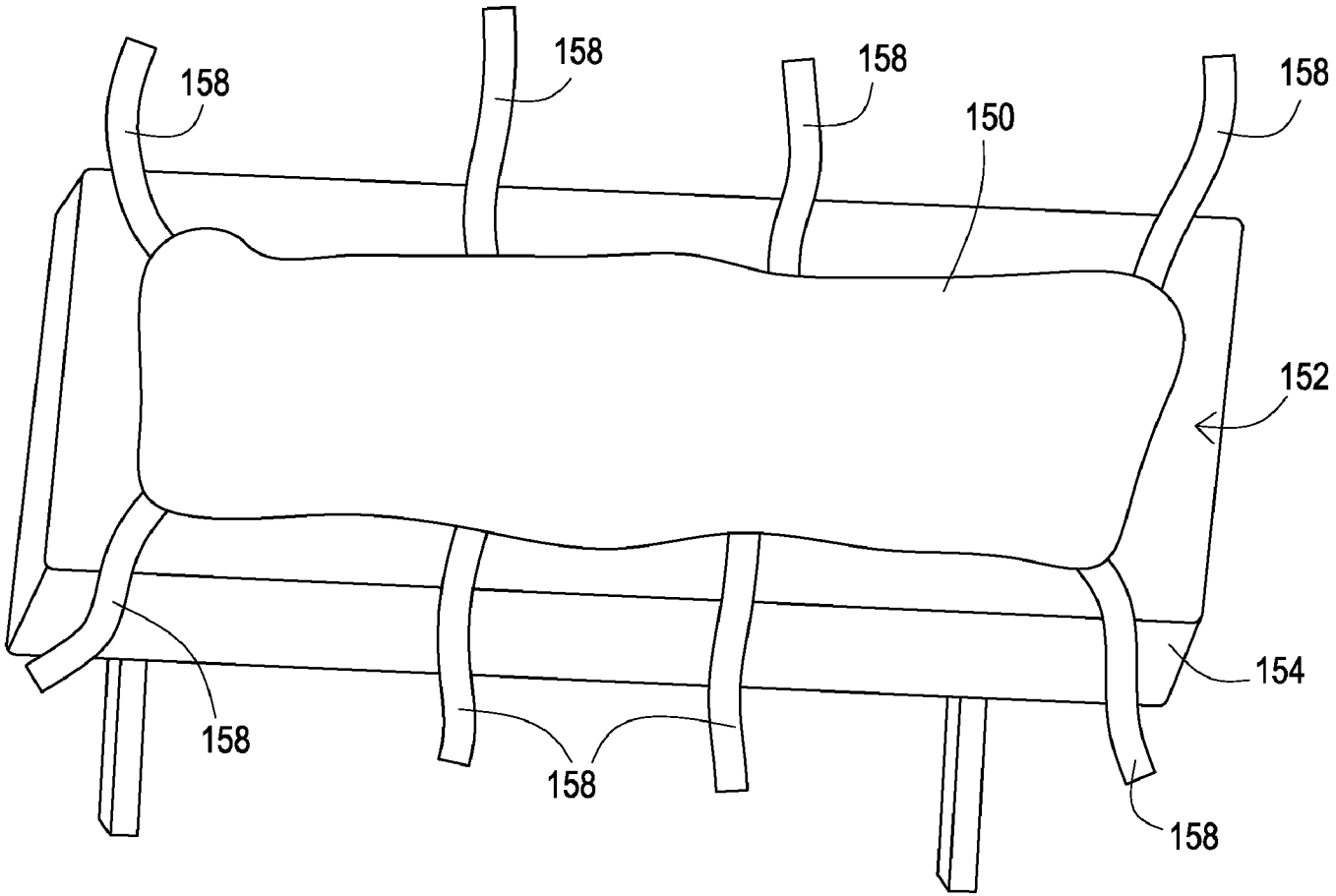
FIG. 2 is a perspective view of an exemplary hospital bed with a sling portion according to an embodiment.

As best seen in FIG. 2, a sling portion 150 may be placed on the upper surface 152 of an exemplary hospital bed or stretcher 154. The sling 150 includes a plurality of straps 158 extending from the periphery of the sling 150 for lifting the sling 150.

In operation, the sling 150 is positioned on a patient support surface, such as the bed 154, generally as shown in FIG. 2. A patient P may then be positioned on the sling 150, as generally depicted in FIG. 4. The apparatus 20 may be in the first configuration of FIGS. 1 and 3 where the proximal portion 70 of the frame 24 extends generally in parallel to the axis C-C or a suitable angle (appropriate) between axis C-C and axis B-B to provide clearance. The axles 100, 120 may then be positioned to avoid contact between the axles 100, 120 and the bed 154. The apparatus 20 may then be positioned relative to the bed 154 (by moving the apparatus 20 generally parallel to the axis B-B) and the frame 24 may be rotated about the axis A-A to the position shown in FIG. 4 such that the frame opening 80 at least partially encircles the patient P. When in the position shown in FIG. 4, the straps 158 may be coupled to the buckles 82 and tightened. Then, the lifting actuator 96 may raise the arm 90 and frame 22 generally in the direction U until the patient P and the sling 150 clear the upper surface 152 of the bed 154. Then, the apparatus 20 and the patient P may be moved to another bed. Before transporting, axles 100, 120 may then be positioned to provide a shorter wheelbase for maneuvering. When one desires to position the patient P on a surface (such as a second bed), the apparatus 20 is maneuvered via the wheels 104, 106, 124, 126 such that the patient P is directly over the surface. The control 34 is then used to send a signal to the driver 90 for lowering the patient P onto the surface. Then, the strap portions 158 are uncoupled from the frame 24. The frame may then be rotated or raised, or both, and the apparatus 20 may be moved away from the patient P.

In the embodiment illustrated, the frame 24 is constructed of tubular steel, although other suitable materials may be used.

Although the steps of the method of using the apparatus 20 may be listed in an order, the steps may be performed in differing orders or combined such that one operation may perform multiple steps. Furthermore, a step or steps may be initiated before another step or steps are completed, or a step or steps may be initiated and completed after initiation and before completion of (during the performance of) other steps.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A supine lift and stretcher apparatus, comprising:

a base portion at least partially defined by an elongated portion extending generally in a first orthogonal direction and having a first end, a second end, and a central portion interposed there between;

a frame having a first lateral portion extending in the first orthogonal direction and defining a first lateral portion distal end and a first lateral portion proximal end, a second lateral portion defining a second lateral portion distal end and a second lateral portion proximal end, a proximal portion interconnecting the first lateral portion proximal end and the second lateral portion proximal end, and a distal portion extending generally in a second orthogonal direction interconnecting the first lateral portion distal end and the second lateral portion distal end, wherein at least two of the first lateral portion, the second lateral portion, the proximal portion, and the distal portion define a frame opening;

an upper member having the first lateral portion at least partially interposed therein;

a lifting portion interconnecting the base with the upper member to move the frame relative to the base generally in a third orthogonal direction;

a first axle portion having at least one wheel to transport the apparatus;

a second axle portion having at least one wheel to transport the apparatus, wherein the first axle portion and the second axle portion are coupled to the base; and a movable guide wheel attached centrally to the base frame parallel to a long axis of the frame using an enclosed hand operated mechanical or electrically actuated device attached to a wheel mount to raise the at least one wheel from floor contact or to force the at least one wheel into floor contact with a predetermined force.

2. The apparatus of claim 1, wherein the first axle portion and the second axle portion is moved relative to the base to increase and decrease a wheelbase and is moved while the apparatus is in use.

3. The apparatus of claim 1, wherein the first axle portion and the second axle portion each include two wheels.

4. The apparatus of claim 1, further comprising a sling portion having a plurality of strap portions to couple the sling portion to the frame.

5. The apparatus of claim 4, further comprising the sling portion selectively coupled to the frame.

6. The apparatus of claim 5, wherein the lifting portion will selectively move the frame upward such that a patient in the sling portion is raised above a surface.

7. The apparatus of claim 1, wherein the frame is coupled to the lifting portion such that the frame is rotated generally about an axis parallel to the first orthogonal direction and the lifting portion.

8. The apparatus of claim 1, wherein the upper member is coupled to the first lateral portion such that the frame is rotated relative to the upper portion.

9. The apparatus of claim 1, further comprising a plurality of buckle portions attached to the frame to attach a sling to the frame.

10. The apparatus of claim 1, further comprising a control device to raise and lower the frame and to move the first axle portion and the second axle portion relative to the base to increase and decrease a wheelbase.

11. The apparatus of claim 1, further comprising a covered lower control portion including a driver operating a lower control arm and floor rolling contacting portion parallel to the base to exert a force on a floor that the apparatus is supported on to provide transport guidance.

* * * * *